US009392927B2

(12) United States Patent
Lundberg et al.

(10) Patent No.: US 9,392,927 B2
(45) Date of Patent: Jul. 19, 2016

(54) TABLE TOP DISHWASHER

(75) Inventors: Mats Lundberg, Vaellingby (SE); Luigi Salerno, Cinisello Balsamo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 161 days.

(21) Appl. No.: 13/989,874

(22) PCT Filed: Sep. 21, 2011

(86) PCT No.: PCT/EP2011/066368
§ 371 (c)(1),
(2), (4) Date: Apr. 9, 2014

(87) PCT Pub. No.: WO2012/069227
PCT Pub. Date: May 31, 2012

(65) Prior Publication Data

US 2014/0230864 A1 Aug. 21, 2014

(30) Foreign Application Priority Data

Nov. 26, 2010 (EP) ..... 10015028

(51) Int. Cl.
*A47L 15/42* (2006.01)
*A47L 15/00* (2006.01)

(52) U.S. Cl.
CPC ..... *A47L 15/4223* (2013.01); *A47L 15/0089* (2013.01)

(58) Field of Classification Search
None
See application file for complete search history.

(56) References Cited

U.S. PATENT DOCUMENTS

| | | | | |
|---|---|---|---|---|
| 1,853,529 | A | 4/1932 | Zademach | |
| 3,060,946 | A | 10/1962 | Lantz | |
| 3,060,947 | A | 10/1962 | Lundstedt | |
| 3,060,948 | A * | 10/1962 | Lundstedt | 134/186 |
| 3,807,636 | A | 4/1974 | Fackler | |
| 4,553,308 | A * | 11/1985 | Botsolas | 29/450 |
| 4,836,230 | A * | 6/1989 | Elliott | 134/138 |
| 5,431,456 | A * | 7/1995 | Okumura et al. | 285/133.4 |
| 8,459,064 | B2 * | 6/2013 | Haltmayer | A47L 15/4223 248/75 |

FOREIGN PATENT DOCUMENTS

| | | | |
|---|---|---|---|
| DE | 4438279 | A1 | 5/1996 |
| DE | 102004057019 | A1 | 6/2006 |

(Continued)

OTHER PUBLICATIONS

International Searching Authority, International Search Report for International Application No. PCT/EP2011/066368, mailed Jan. 20, 2012, 4 pages, European Patent Office, The Netherlands.

*Primary Examiner* — Michael Barr
*Assistant Examiner* — Cristi Tate-Sims
(74) *Attorney, Agent, or Firm* — Alston & Bird LLP

(57) ABSTRACT

A table top washing machine comprises a tub (14) for accommodating articles to be cleaned, means for circulating water within the tub, and a waste water drain (51) comprising a drain port (52) for draining water from the tub and a fitting (54) for connecting a waste line (26) to said drain port. In accordance with the present invention the waste water drain comprises an angled connector (56) having a first leg (58) for connection to the drain port (52) and a second leg (60) comprising the fitting (54), wherein said first leg is adapted for rotatable connection to the drain port, and wherein said waste water drain further comprises means (69, 70, 72, 74, 76) for limiting rotation of the first leg such that orienting the second leg to point in an upward direction is prevented.

14 Claims, 4 Drawing Sheets

(56) References Cited

FOREIGN PATENT DOCUMENTS

| | | | |
|---|---|---|---|
| EP | 0709055 | A1 | 5/1996 |
| EP | 2184000 | A1 | 5/2010 |
| FR | 2335189 | A1 | 7/1977 |
| WO | WO-2010/052021 | A1 | 5/2010 |
| WO | WO-2011/015313 | A1 | 2/2011 |
| WO | WO-2012/016631 | A2 | 2/2012 |
| WO | WO-2012/016632 | A2 | 2/2012 |
| WO | WO-2012/016710 | A2 | 2/2012 |

* cited by examiner

TABLE TOP DISHWASHER

CROSS REFERENCE TO RELATED APPLICATIONS

This application is a national stage application, filed under 35 U.S.C. §371, of International Application No. PCT/EP2011/066368, filed Sep. 21, 2011, which claims priority to European Patent Application No. 10015028.3, filed Nov. 26, 2010, both of which are hereby incorporated by reference in their entirety.

The present invention relates to a table top washing machine which comprises a tub for accommodating articles to be cleaned, means for circulating water within the tub, and a waste water drain comprising a drain port for draining water from the tub and a fitting for connecting a waste line to said drain port.

The term "table top washing machine" as used herein refers to a washing machine, i.e. a dishwasher or washing machine for washing clothes, which in contrast to common floor-mounted appliances is designed as a smaller unit which may be placed for example on a kitchen worktop or as portable device. Such washers are particularly suited for smaller households, in which only small amounts of articles are to be cleaned, or for use in mobile vehicles such as motor homes, camper vans, yachts and the like.

It is an object of the present invention to provide for a table top washing machine of the type indicated above which allows for a high degree of flexibility in use, wherein measures are taken that a relocation of the washing machine does not impart operation of the washing machine.

In accordance with the present invention the above object is solved in that the waste water drain comprises an angled connector having a first leg for connection to the drain port and a second leg comprising the fitting, wherein the first leg is adapted for rotatable connection to the drain port, and wherein the waste water drain further comprises means for limiting rotation of the first leg such that orienting the second leg to point in an upward direction is prevented. By providing for a rotatable connection of the first leg to the drain port, the table top washing machine can be easily adapted for installation next to a drain site, such as a kitchen sink into which the waste line is placed. Thus, for example in such latter embodiment the table top washing machine could be easily installed either to the right or to the left of the sink wherein, due to the rotatable connection, the waste line can be easily installed to be directed towards the sink, such that the formation of bows or bends in the waste line can be avoided. Furthermore, since the rotatable connection of the first leg to the drain port is designed such that it allows rotation of the first leg only to an extent that orienting the second leg to point in an upward direction is prevented, i.e. allows orienting the second leg only either to be directed downwardly or at maximum horizontally, a back flow of water within the waste line is prevented. In this manner it is guaranteed that the waste line always is completed emptied to the drain so as to avoid water from spilling out of the waste line when the machine is relocated, which is of particular advantage in embodiments wherein the machine is a portable device.

Preferred embodiments of the present invention are defined in the dependent claims.

Limiting rotation of the first leg such that orienting the second leg to point in an upward direction is prevented is of particular advantage for devices wherein the washing machine is adapted to drain water from the tub solely by the hydrostatic pressure prevailing within the tub. Thus, the washing machine can be designed to be a particularly lightweight machine which does not have a drain pump but which only has a valve in the drain line which when opened causes the tub to be drained. By allowing the second leg which comprises the fitting for the waste line to be oriented only to either point downwards or to be oriented horizontally, the buildup of a back pressure in the waste line is effectively prevented.

The means for limiting rotation of the first leg preferably comprises a first and a second cam surface which are provided at the first leg, wherein a first and a second stop are provided at a housing member of the washing machine, which stops engage the first and second cam surfaces, respectively, at the positions of maximum displacement of the first leg. By selecting respective angular positions with respect to the axis of rotation of the first leg at which the first and second cam surfaces engage the stops, rotation of the first leg can be restricted to any desired angular range.

In such latter embodiments, the washing machine preferably comprises a cam member which radially projects from the first leg of the connector and which comprises both the first and the second cam surface. The first and the second cam surfaces for example can comprise opposing faces of a radial projection provided at the first leg, or can be provided at individual radial projections provided at the first leg.

Preferably the first and second legs of the connector are arranged substantially at a right angle to each other, in which manner it is possible to provide for a connection to the waste line that is located at a wall member of the washing machine, for example at the rear side of the washing machine, wherein the waste line is rotatable by 180° so that it can be positioned to either be directed to the left or to the right of the washing machine. Due to the right angle of the connector, the waste line further can be positioned to extend in parallel to the rear housing wall of the washing machine such that a minimum amount of space is required for placement of the waste line. In this manner the total space required for placement of the washing machine can be minimized. Thus, if for example the washing machine is to be placed in front of a kitchen wall, the washing machine can be located directly in front of such wall at a minimum distance to the wall.

In order to prevent an inadvertent rotation of the connector, the washing machine preferably comprises means for securing the connector in a desired rotational position. Such means for securing the connector can comprise for example a bracket for fixation of the first or second leg.

Preferably the washing machine comprises a releasable hydraulic connection between the drain port and the first leg, so that particularly when the washing machine is a portable machine, the waste line can be easily disassembled and reassembled when relocating the washing machine.

To this end, the drain port can comprise an external thread and the first leg can comprise a cap nut for fixation of the first leg at the drain port. Alternatively, the drain port could comprise one or more latching projections and the first leg could comprise a cap having corresponding latching surfaces so as to provide for a bayonet connection between the drain port and the first leg.

In further preferred embodiments of the present invention, the drain port is located in a recess which is provided in a rear wall or a side wall of the washing machine. Alternatively, the drain port could be located in a recess which is provided in a bottom wall of the washing machine. Locating the drain port in a recess allows for a particular compact design in which the waste line extends in parallel and at a minimum distance to a housing wall of the washing machine.

When the drain port is located in a recess which is provided in a bottom wall of the washing machine, the bottom wall further can comprise a channel for accommodation of the waste line. In this manner washing machines can be implemented in which the waste line exits at one of the sidewalls of the washing machine, wherein by rotating the waste line into a desired direction and arranging the waste line in the respective channel the washing machine can easily be adapted to the specific circumstances of its placement, wherein only that portion of the waste line is visible which extends between the washing machine and a drain site, such as a kitchen sink, wherein however no room is required at the rear side of the washing machine for passage of the waste line. Thus, this feature likewise allows for a particularly compact design of the dishwasher wherein the dishwasher can be placed with a minimum distance in front of a wall member or the like.

The washing machine, which in preferred embodiments is a table top dishwasher, further can comprise a water tank for supplying the water for at least one washing cycle. Thus no hydraulic connections are required for permanently connecting the washing machine to a water supply, such as a tap. Rather, before carrying out a washing cycle, the water tank is filled so as to supply the water for a washing cycle to be carried out in the washing machine. To facilitate the filling of the water tank, the water tank preferably is a portable tank, such as a tank that is integrated into the washing machine, but which can be removed from the machine for a filling operation. In such embodiments, for operation of the washing machine only the waste line has to be arranged to terminate at a suitable drain, such as a kitchen sink, wherein except for the provision of electric energy no further installations have to be made. Such a dishwasher is particularly suitable for use in mobile vehicles such as motor homes, camper vans, yachts and the like, where no permanent water supply is available. Washing machines having a water tank further can be used with advantage at locations where water supply is provided only during certain times of the day, or where there is a permanent water supply, such as a continuously supplied water tap, but where the provision of a suitable port for connection to the machine cannot be readily established.

Preferred embodiments of the present invention are described by reference to the drawings, in which:

FIG. 1 shows a dishwasher 10, which can be placed on top of a kitchen console 11 or which also could be used as a portable device for use, for example, within a camper van or yacht.

Figure 1:
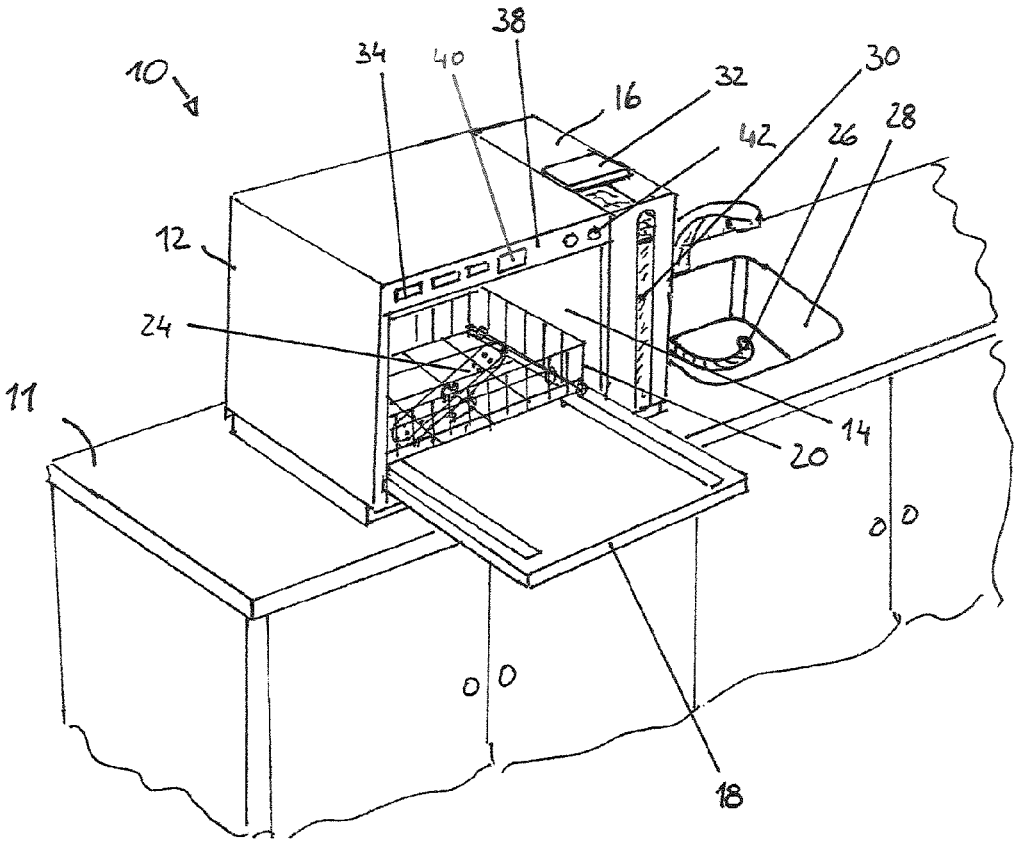
FIG. 1 is a perspective view of a table top dishwasher in accordance with the present invention.

Dishwasher 10 comprises a housing section 12 and a tank section 16 into which a volume of water is filled as it is required for an intended washing operation. In order to access the washing chamber, housing section 12 is provided with a door 18, which is tiltable about a vertical axis and which in the usual manner constitutes in its open state a support surface, on which a basket 20 can be placed, which holds any goods to be cleaned. Within the lower section of the washing chamber or tub 14 there is provided a sump 22, in which water that is sprayed onto the goods to be cleaned by means of a rotatable spray arm 24 collects, to be again sprayed onto the goods to be cleaned.

Any water which no longer is required for the washing cycle can be drained to waste via a drain conduit 26, the free end of which can be arranged temporarily within a sink 28 or which could be connected fixedly for example to a drain pipe of sink 28.

As shown in FIG. 1, tank 16 can be equipped with a window 30 through which the filling level of tank 16 is visible also when the lid 32 of tank 16 is closed. At the front side of the closed door or, as shown in the drawing, at a front panel 38 provided at the front side of housing section 12 there are provided one or more selector switches 42 for selecting between a plurality of operational settings, and indicator lamps 34 and displays 40 by means of which a variety of operational states or warning messages can be issued to a user of the washing machine.

Figure 2:
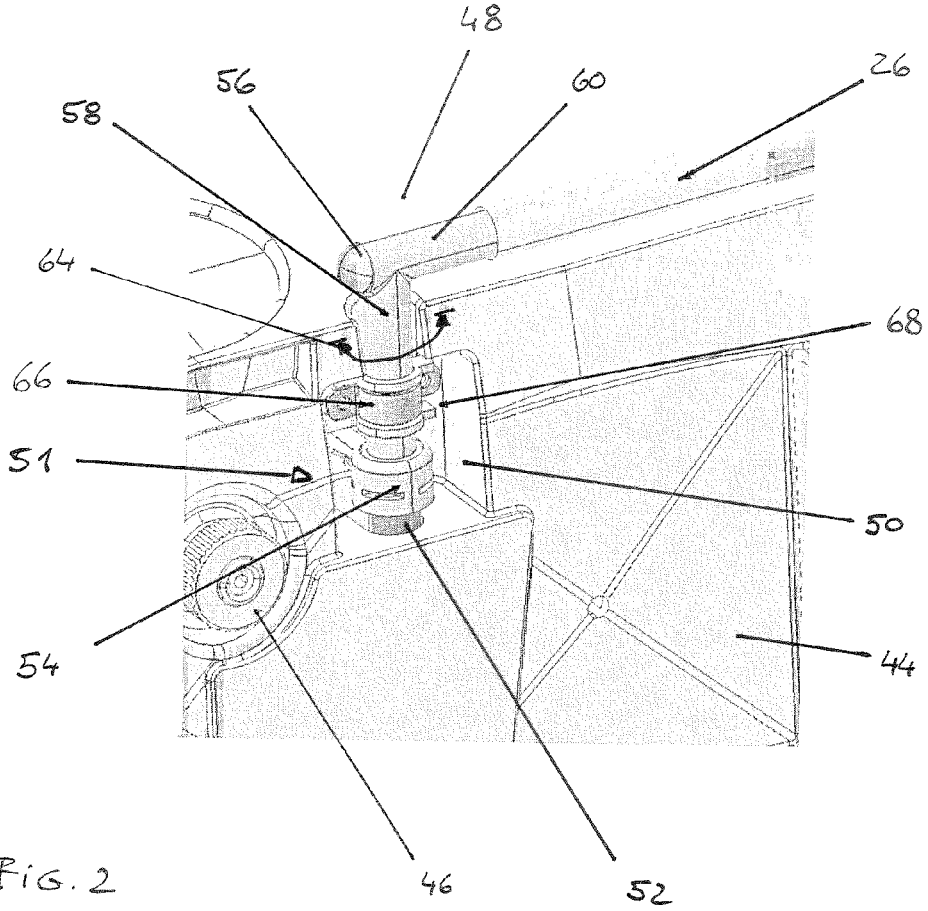
FIG. 2 is a perspective view of the connector for the waste line of the dishwasher shown in FIG. 1.

In FIG. 2 there is illustrated an embodiment of a waste water drain 51 of the table top dishwasher shown in FIG. 1, wherein FIG. 2 shows a section of the dishwasher 10 when viewed from below.

In particular, FIG. 2 shows a portion of the bottom wall 44 in the region of the right rear foot 46 which is located close to the rear wall 48. Within a recess 50 which is provided in the bottom wall 44 at a relatively short distance to the rear wall 48 there is arranged a drain port 52 via which water from the sump 22 can be drained to waste. Drain port 52 is adapted for connection to a coupling 54 of an angled connector 56 which comprises a first leg 58 which carries coupling 54 and a second leg 60 that is adapted for connection to the waste line 26 via which waste water can be passed from drain port 52 to a waste site such as sink 28 shown in FIG. 1. The first and second legs 58, 60 of connector 56 are arranged at a right angle so that the second leg 60 of connector 56 and waste line 52 extend in parallel to rear wall 48 and. By selecting on the one hand the distance between recess 50 and the rear wall 48 and on the other hand the length of first leg 58, the second leg 60 of connector 56 and correspondingly the waste line 52 can be located to extend at a minimum distance to back wall 48.

Connector 56 is designed to be rotatable by 180° as is indicated in FIG. 2 by an arrow 64 and thus can be arranged in the position shown in FIG. 2 wherein the second leg extends horizontally and points to the left of dishwasher 10, in the opposite orientation wherein second leg 60 extends again horizontally but points to the right, or in any intermediate position in which the second leg 60 of connector 56 points downwardly. In order to fix connector 56 at a desired angular position there is provided a clamp 66 which extends over a section of first leg 58 and which can be fixed to bottom wall 44 for example by means of screws (not shown). The angular range of rotation of connector 56 is limited by means of cam members 68 which are shown in further detail in FIG. 3.

Figure 3:
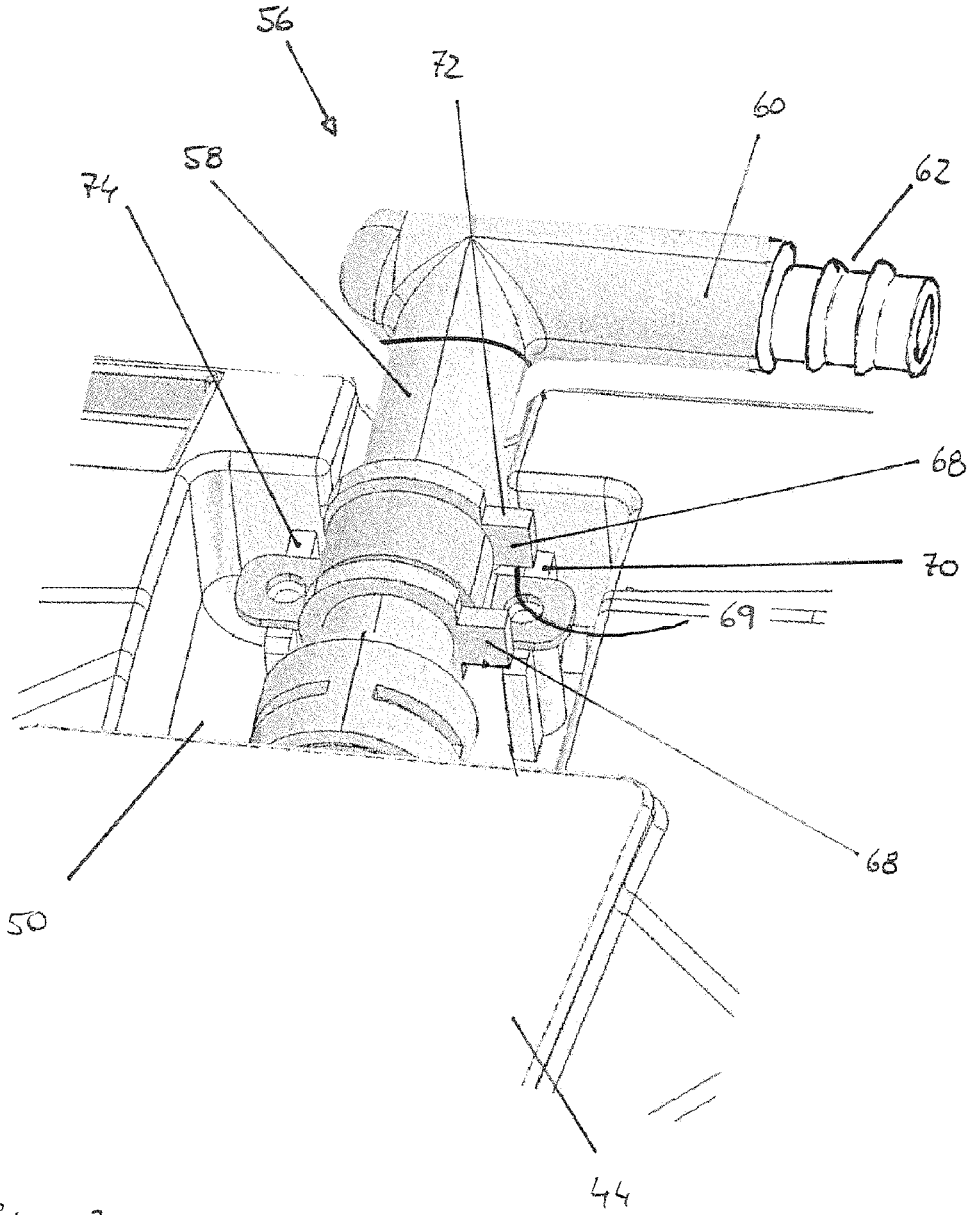
FIG. 3 is an enlarged view of the connector shown in FIG. 2.

As shown in FIG. 3, whereas the second leg 60 of connector 56 is provided with a fitting 62 for fixation of waste line 26, first leg 58 comprises two integrally formed cam members 68 which radially project from first leg 58. Cam members 68 each comprise two lateral cam surfaces which at the position of maximum displacement engage a respective abutment surface provided at the machine housing. In particular, in the position shown in FIG. 3 a first cam surface 69 of cam member 68 engages a first stop 70 which is provided within recess 50 of bottom wall 44. When the angled connector 56 is rotated so that the second leg 60 in the bottom view of FIG. 3 extends to the left, i.e. extends toward the right of the dishwasher 10 shown in FIG. 1, a second cam surface 72 of cam member 68 abuts against a second stop 74.

By limiting rotation of connector 56 to an angular range of the second leg 60 which at maximum is horizontal or else points downwards, it is guaranteed that any water that has been drained from sump 22 of tub 14 and which exits via drain port 52 can flow out into the waste line 26. Thus, particularly in washing machines in which there is no drain pump but wherein the water from the tub is drained solely by the hydrostatic pressure prevailing within the tub, malfunction of the washing machine thus effectively is prevented.

As will be readily understood, locating the drain port within a recess provided in the bottom wall of the washing machine not only assists draining of the tub since in that manner the drain port can be located in a position as low as possible so as to provide for a maximum height difference between sump and drain port, but further allows to arrange the waste line 52 such that the placement of the waste line requires only a minimum amount of space.

Figure 4:
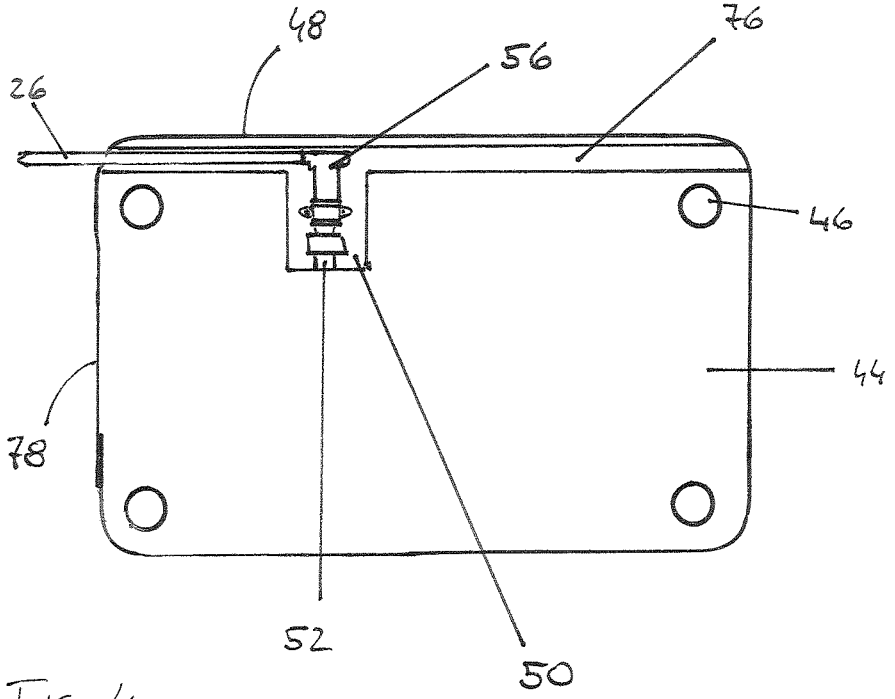
FIG. 4 is a schematic bottom view of a further embodiment of a table top washing machine in accordance with the present invention.

Furthermore, the dishwasher also can be designed for concealed placement of the waste line 26. To this end, as is illustrated in FIG. 4, the drain port 52 can be arranged at a distance from rear wall 48 which exceeds that required for accommodation of the connector 56, wherein the drain port 52 and the connector 56 can be arranged in the bottom region of the washing machine within a recess 50 which merges into a channel 76 which extends in parallel to the rear wall 48. Channel 76 is adapted to accommodate waste line 26 so that the waste line 26 exits at one of the sidewalls 78 of the dishwasher housing. In the embodiment shown in FIG. 4 the dishwasher 10 thus can be installed without there being required any space behind the rear wall 48 so that if for example the dishwasher 10 of FIG. 1 is placed on a kitchen work top 11 it can be pushed completely to the wall behind kitchen work top 11.

While in the embodiment shown in FIG. 4 the waste water drain can have a configuration similar to that of waste water drain 51 shown in FIGS. 2 and 3, it should be noted that in the FIG. 4 embodiment rotation of the connector 56 is restricted by channel 76, so that by providing for a suitable configuration of channel 76 cam member 68 of connector 56 as well as the stops 70 and 74 within recess 50 can be omitted.

LIST OF REFERENCE SIGNS

10 dishwasher
11 kitchen console
12 housing section
14 washing chamber/tub
16 tank section
18 door
20 basket
22 sump
24 spray arm
26 drain conduit
28 sink
30 window
32 lid
34 indicator lamps
38 front panel
40 display
42 selector switch
44 bottom wall
46 foot
48 rear wall
50 recess
51 waste water drain
52 drain port
54 coupling
56 connector
58 $1^{st}$ leg
60 $2^{nd}$ leg
62 fitting
64 arrow
66 clamp
68 cam member
70, 74 stop
69, 72 cam surface
76 channel
78 side wall

The invention claimed is:

1. A table top washing machine, comprising:

a tub for accommodating articles to be cleaned with circulating water within the tub; and a waste water drain comprising a drain port for draining water from the tub and a fitting for connecting a waste line to said drain port;

wherein said waste water drain comprises an angled connector having a first leg for connection to the drain port and a second leg comprising the fitting, wherein said first leg is adapted for rotatable connection in a plane of rotation to the drain port such that a secure connection between the first leg and the drain port is maintained during rotation, and wherein said waste water drain further comprises one or more stop members for limiting rotation of the first leg between a first stop position and a second stop position in the plane of rotation such that orienting the second leg to point in an upward direction is prevented.

2. The washing machine of claim 1, which is adapted to drain water from the tub solely by the hydrostatic pressure prevailing within the tub.

3. The washing machine of claim 1, wherein said one or more stop members comprises a first and a second cam surface provided at the first leg, and a first stop and a second stop are provided at a housing member of the washing machine to engage the first and second cam surfaces, respectively, at the first and second stop positions of the first leg, respectively.

4. The washing machine of claim 3, comprising a cam member radially projecting from the first leg and having the first and second cam surfaces.

5. The washing machine of claim 1, wherein the first and second legs are arranged substantially at a right angle to each other.

6. The washing machine of claim 1, further comprising at least one clamping member for securing the connector in a desired rotational position.

7. The washing machine of claim 6, wherein said clamping member for securing the connector in a desired rotational position comprises a bracket for fixation of the first or second leg.

8. The washing machine of claim 1, comprising a releasable hydraulic connection between the drain port and the first leg.

9. The washing machine of claim 8, wherein the drain port comprises an external thread and the first leg comprises a cap nut for fixation of the first leg at the drain port.

10. The washing machine of claim 1, wherein the drain port is located in a recess provided in a rear or side wall of the washing machine.

11. The washing machine of claim 1, wherein the drain port is located in a recess provided in a bottom wall of the washing machine.

12. The washing machine of claim 11, wherein said bottom wall further comprises a channel for accommodation of said waste line.

13. The washing machine of claim 1, which is a table top dishwasher.

14. The washing machine of claim 1, comprising a water tank for supplying the water for at least one washing cycle.

* * * * *